US005375540A

United States Patent [19]

Verrecchia et al.

[11] Patent Number: 5,375,540

[45] Date of Patent: Dec. 27, 1994

[54] SYSTEM FOR BURNING BIO-MASS AND SYNTHETIC SOLID FUEL

[75] Inventors: Joseph Verrecchia, Pawtucket; Irwin H. Loft, Barrington, both of R.I.

[73] Assignee: Federal Energy Corporation, North Kingstown, R.I.

[21] Appl. No.: 139,206

[22] Filed: Oct. 19, 1993

Related U.S. Application Data

[63] Continuation-in-part of Ser. No. 111,478, Aug. 25, 1993.

[51] Int. Cl.[5] ..... F23G 5/00

[52] U.S. Cl. ..... 110/257; 110/255; 110/259; 110/269; 110/317

[58] Field of Search ..... 110/257, 255, 259, 269, 110/328, 317

[56] References Cited

U.S. PATENT DOCUMENTS

| | | | |
|---|---|---|---|
| 1,960,718 | 5/1934 | Standifier et al. | 110/269 X |
| 3,861,331 | 1/1975 | Saitoh et al. | 110/257 |
| 4,765,256 | 8/1988 | Caughey | 110/269 X |
| 5,216,967 | 6/1993 | Mormino | 110/255 X |

*Primary Examiner*—Edward G. Favors
*Attorney, Agent, or Firm*—Robert J. Doherty

[57] ABSTRACT

A device for improved burning of bio-mass fuels such as corn wherein the fuel is supported within a fixed combustion chamber upon a continuous track which continuously intermittently moves such that as the fuel is consumed the ash produced thereby is continuously removed from the combustion chamber while new fuel is continuously added thereto so as to greatly increase the operational cycle of the device.

10 Claims, 4 Drawing Sheets

SYSTEM FOR BURNING BIO-MASS AND SYNTHETIC SOLID FUEL

This application is a continuation-in-part of application Ser. No. 08/111,478 filed Aug. 25, 1993.

FIELD OF INVENTION

This invention relates specifically to all bio-mass and synthetic solid fuel burning energy producing systems.

BACKGROUND AND OBJECTS OF THE INVENTION

Concern for the environment is a pre-eminent social issue for the decade of the 90's. Emissions from heating with corn pellets have been tested and labeled exempt by the Environmental Protection Agency. Other natural fuel such as wheat, rice, rye and soy beans for example burn equally as well and as clean as corn. Since natural grains burn cleanly without generating creosote, an oily residue, there is no need for a chimney. The burning of natural grain fuel generates emissions less than ten percents of the Environmental Protection Agency's standards for carbon dioxide. Such emissions release no other known harmful contaminants or hydrocarbon pollutants into the atmosphere.

Recent announcements by the OPEC Oil Cartel indicates new crude oil price increases foreshadowing what many experts are predicting may be the beginning of a new oil crises. Present oil, gas and coal reserves are being depleted rapidly. Although experts vary in their predictions as to when these fossil fuels will become exhausted, the consensus of expert opinion is that the supply of such fossil fuels will eventually be exhausted.

Corn, wheat, rye, rice and other natural bio-mass fuels are grown commercially in the United States as well as many other countries . In the United States, farmers have been paid subsidies not to raise certain farm products resulting in much of our cropland lying idle. The burning of bio-mass fuel in it's natural condition insures a home for agricultural products at a reasonable price thus smoothing out the elasticity curve for supply and demand.

Natural bio-mass fueled energy is both accessible and affordable to homes and industry. The costs and taxation of existing sources of energy continues to escalate necessitating the end user and taxpayer to seek out inexpensive alternative energy supplies.

A confining restriction of the present bio-mass and synthetic solid fuel burning industry is the repetitive requirement to shut down the system every twelve to twenty hours. This shut down is to remove a build up of a hard crustacous outer layer of ash associated with solid fuels known as a clinker. Unless removed, the residue of ash or clinker diminishes the flow of highly turbulent combustion air flow directed to the bio-mass fuel resulting in the flame being extinguished.

Accordingly, a primary object of the present invention is to present a fuel system which eliminates and/or significantly reduces the need to periodically shut down the burning procedure to remove ash and the like in a convenient and efficient manner.

Another object of the present invention is to provide a specifically constructed firebox in such an aforementioned system which enables continuous ash disposal over a long time period such that short term interval periodic shutdown is, in essence, eliminated or reduced to the extent that it is no longer a drawback and to accomplish such in a cost effective and convenient manner.

The aforementioned objects of the present invention as well as other objects thereof are accomplished by the provision of a stationary firebox with a moving floor track which simultaneously forms a portion of the firebox on which combustion is supported and the means whereby the ash therefrom is automatically and sequentially removed therefrom.

These and other objects of the present invention are accomplished by the provision of a device for the improved burning of bio-mass and synthetic solid fuels comprising an outer chamber formed by a plurality of outer housing walls, a combustion firebox mounted in said outer chamber, means for feeding fuel to said firebox, said outer chamber further including means for supplying combustion air to said firebox and means for exhausting combustion gases from said outer chamber, said firebox including stationary side walls laterally spaced from each other in part forming a longitudinally extending trough-like combustion chamber having upstream and downstream ends thereof, said combustion chamber further defined by a stationary wall at said upstream end and a gate at said downstream end and a lower wall disposed between said firebox side walls, said gate having a lower edge positioned proximal to but vertically spaced from said lower wall, and means for longitudinally moving said lower wall between said firebox side walls from said stationary upstream wall towards and past said movable gate so as to continually remove ash from said firebox and deposit such ash into said outer chamber.

Other objects, features and advantages of the invention shall become apparent as the description thereof proceeds when considered in connection with the accompanying illustrative drawings.

DETAILED DESCRIPTION OF THE DRAWINGS

In the drawings which illustrate the best mode presently contemplated for carrying out the present invention:

DETAILED DESCRIPTION OF THE INVENTION

Figure 1:
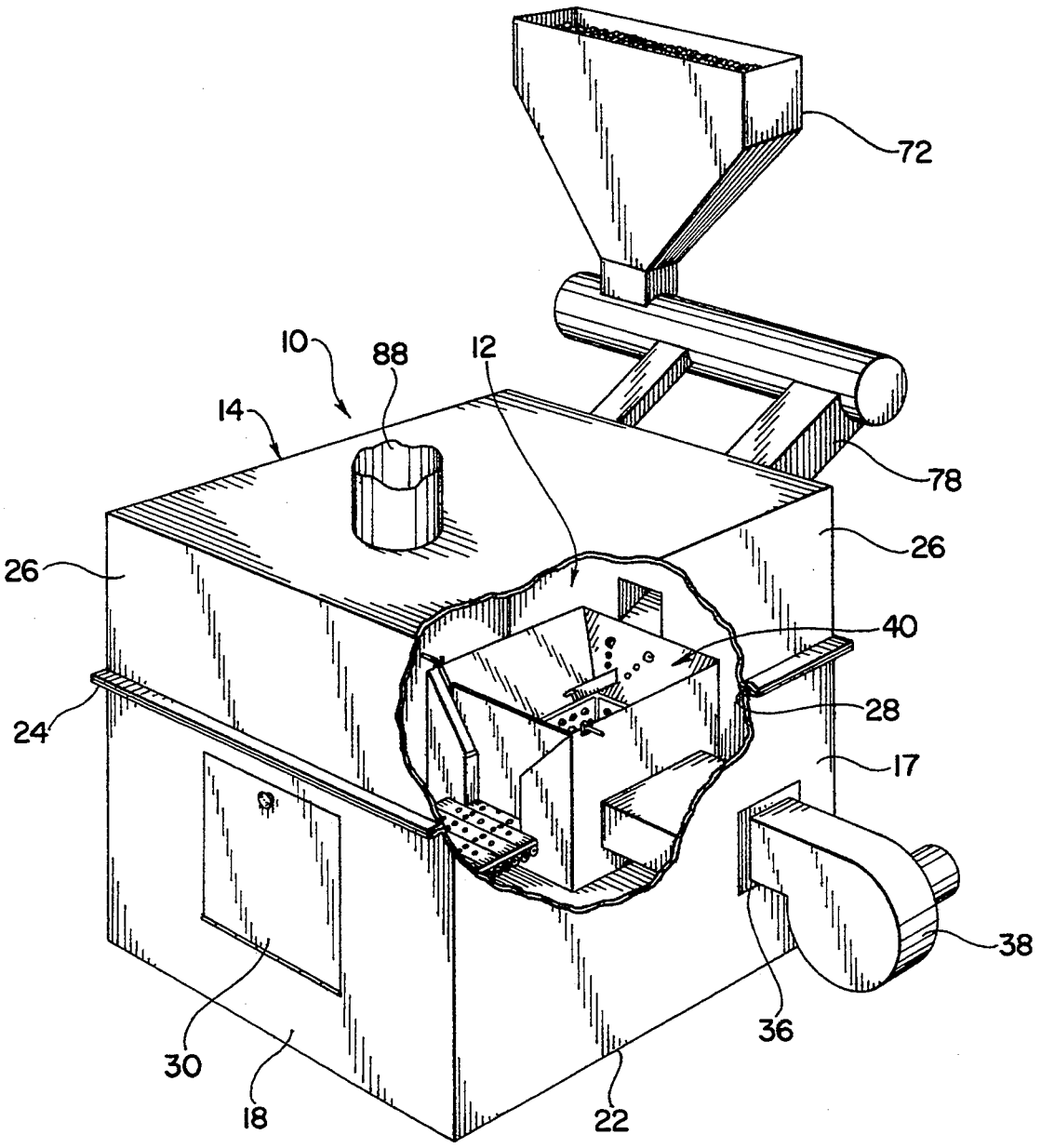
FIG. 1 is a front perspective view of the overall system of the present invention.
Figure 2:
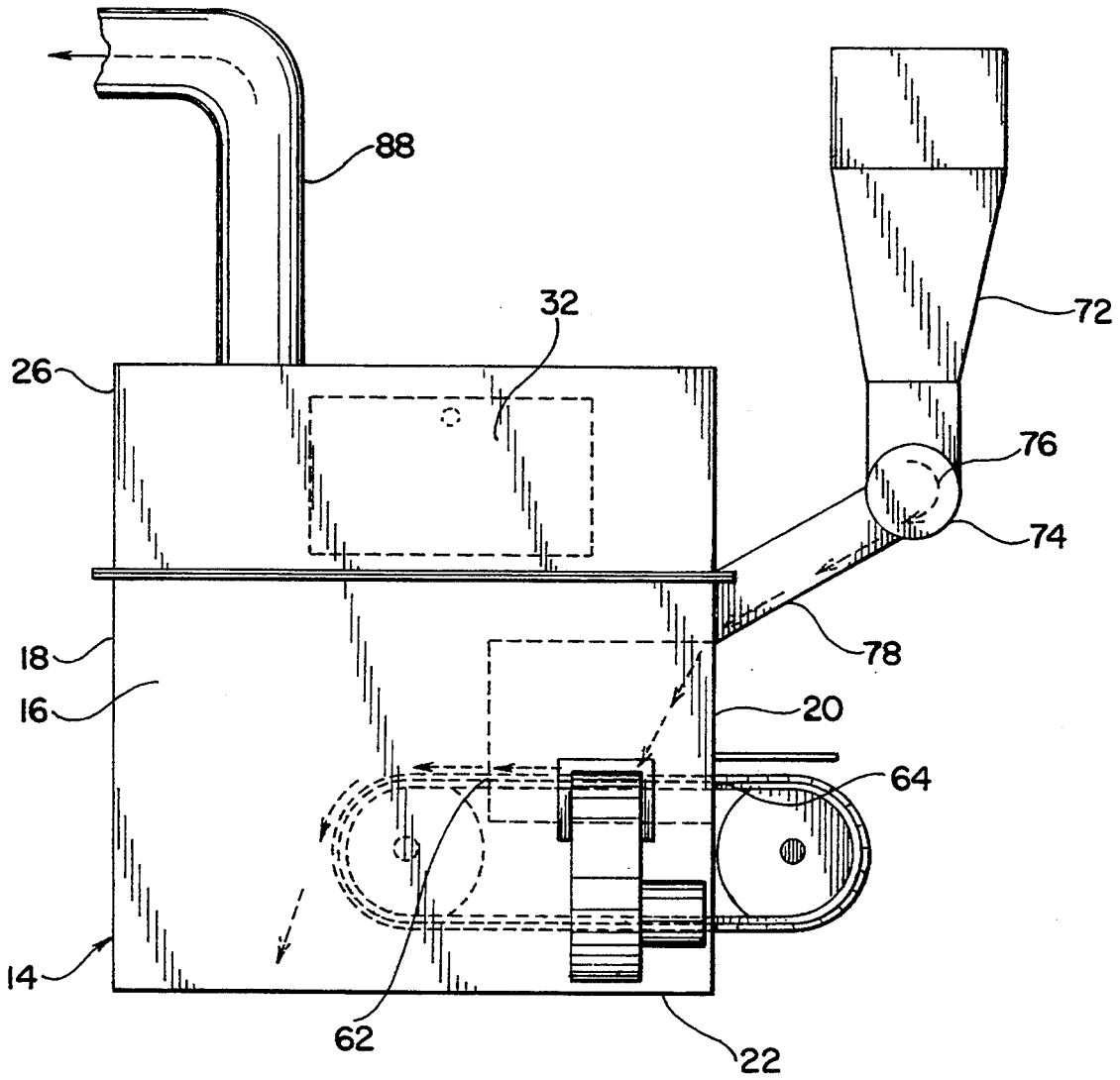
FIG. 2 is a side elevational view taken from the right side of FIG. 1.

Turning now to the drawings and particularly FIGS. 1 and 2 thereof, the overall construction of the combustion system of the present invention is shown. It should be pointed out that while such is specifically depicted as a furnace, stove or space heater arrangement such as would be capable of heating a room, that other systems as specifically previously suggested may also be utilized and that reference to the words "furnace", "stove" and the like includes such other systems.

The furnace 10 of the present invention includes an outer chamber 12 formed from a housing 14 in turn including spaced side walls 16, a front wall 18 and an end wall 20. Such housing 14 further includes a bottom wall 22 all of which are suitably attached to each other such as by welding and like and which exhibit a peripheral upper flange 24 to which a top enclosure 26 is attached by suitable means such as aligned openings provided with nut and bolt pairs. Suitable fire resistant sealing means 28 is provided on the flange 24 prior to the upper and lower housing portions 26 and 14 being joined together.

The front wall 18 is provided with hinged access panel 30 such that the user of the furnace 10 may open such and remove ash from the outer chamber as will hereinafter be more fully explained. Also and as best shown in FIG. 2, the housing is provided with an access panel 32 on the left side wall 16 which is preferably positioned at a vertical height greater than that at which the firebox top in which combustion takes place is positioned and as will be hereinafter more fully brought out. The other or right wall 17 of the housing includes an opening 36 through which a combustion air source such as a blower 38 is positioned.

Figure 4:
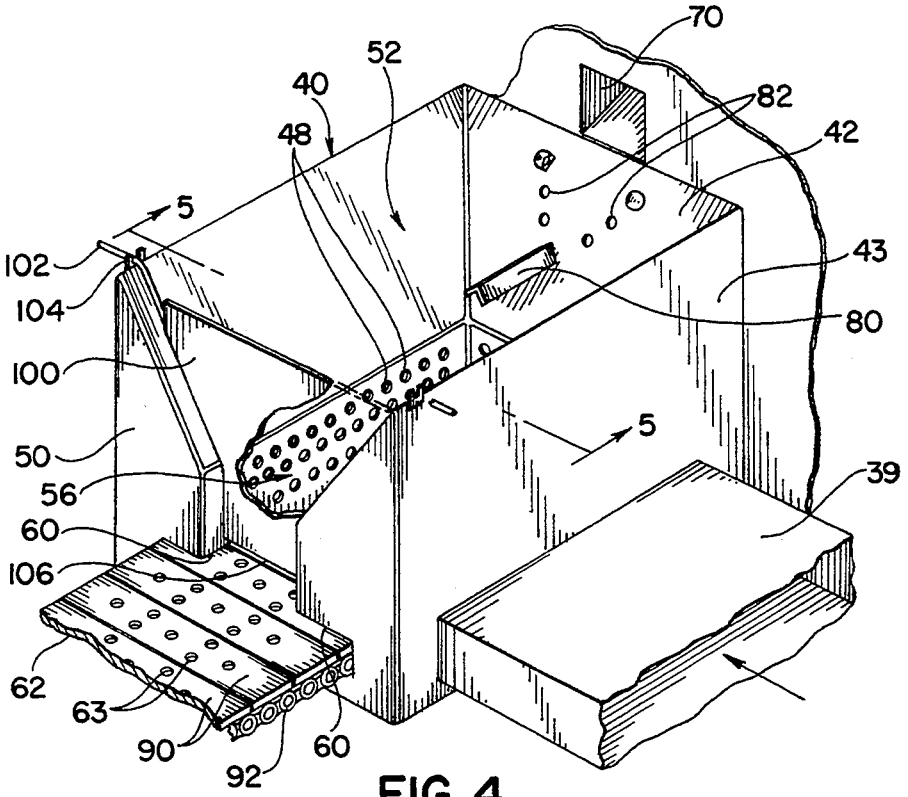
FIG. 4 is a perspective view of the firebox construction.
Figure 6:
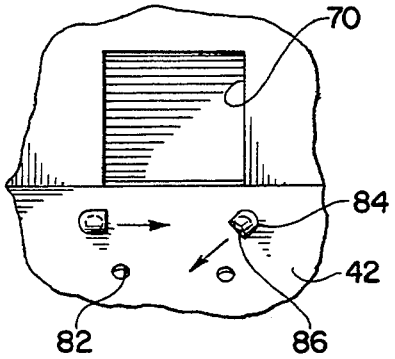
FIG. 6 is a modification of the front firebox wall showing means by which combustion air is specifically deflected from the fuel entrance therein.

Turning now to FIG. 4 of the drawings, the firebox 40 of the present invention is of an overall elongated configuration and includes an upstream wall 42 with a pair of laterally opposed outer side walls 43 and a pair of inner side walls 44 which preferably downwardly inwardly slant and terminate at a straight wall lower terminal portion 46 which is provided with a series of air openings 48. The downstream end of the firebox 40 is provided with opposed end walls 50 laterally spaced from each other and along with a bottom wall 51 are joined with the walls 42 and 44 to, in effect, form a hollow interior portion 52. Opposed plates or sub-bottom walls 54 are disposed along the opposed lateral extent of the firebox which in part define a trough like combustion chamber 56. In addition, the end walls 50 are provided with slots 60 through which an endless belt or track 62 may extend. In addition to the slots 60 in the end walls 50, the front or upstream wall 42 at the lower portions thereof is provided with a similar slot arrangement 64. In this way then, the combustion chamber 56 is in part defined by the track or belt 62 and the opposed side walls 44 and particularly the lower straight wall portions 46 thereof. As will hereinafter be more fully brought out, fuel in the form of grain such as corn and the like is deposited at the upstream end of the combustion chamber 56, burned therein, and then the ash formed thereby removed at the downstream end thereof.

The front wall 42 of the firebox is preferably positioned adjacent to the rear wall 20 of the housing and such rear wall provided with a fuel inlet opening 70 positioned immediately adjacent the upper extent of such wall 42. Fuel fed from a hopper 72 through a distribution system including a tube 74 and an auger or screw 76 insures that a constant or intermittent fuel supply is fed to the opening 72 via a feed shute 78 in turn connected to or terminating at inlet 70. A fuel diverting rod or bar 80 extends longitudinally from the front wall 42 above the combustion chamber 56 such that fuel in the form of corn, etc. as individual pellets is diverted to opposite sides of the firebox to evenly distribute such primarily upon the upper surface of the belt or track 62. It should also be pointed out that initial combustion is normally brought about by the addition of an accelerant to a small pile of fuel, access for which is had through panel 32. After the initial fire is started, the operation of the device takes over to insure continuous combustion and operation of the device as intended.

Figure 5:
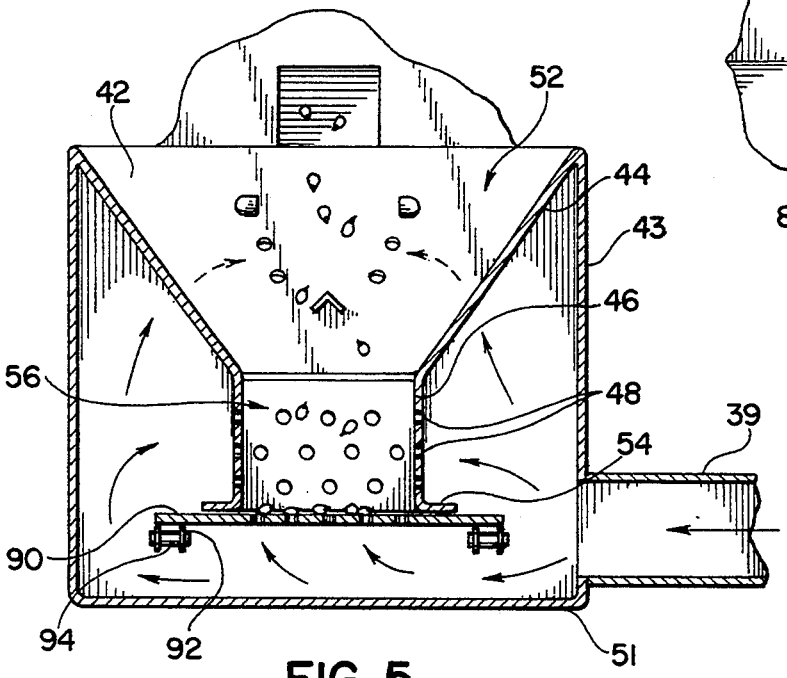
FIG. 5 is a sectional view along the line 5—5 of FIG. 4.

Air such above-indicated combustion is supplied to the combustion chamber 56 via opening 36 by means of the blower 38—it being understood that opening 36 is in communication with the hollow interior of the firebox via a plenum 39 such that such combustion air from the blower is forced into the combustion chamber via the openings 48 in the side wall portions 46 as well as upwardly into the combustion chamber 56 through the openings 63 provided in the track 62. In addition and as best shown in FIGS. 4 and 5, air openings 82 may be provided in the front wall 42 and some of those air openings may be in the form of a rotatable or movable cowl element 84 which, in effect, presents a hood structure 86 to better direct air flow across and slightly downwardly along the front surface of the wall 42 and in this way insure that combustion gases and heat therefrom are swept from or otherwise diverted from the fuel inlet opening 70. As combustion proceeds, combustion gases are removed from the furnace 10 via an exhaust 88 which can be appropriately positioned in the upper cover portion 26 and vented to atmosphere as indicated by the arrow. It should be brought out that with the combustion of such bio-mass and synthetic solid fuels, it is often unnecessary to utilize a chimney structure since creosote and other undesirable residues are not formed by such combustion.

Figure 3:
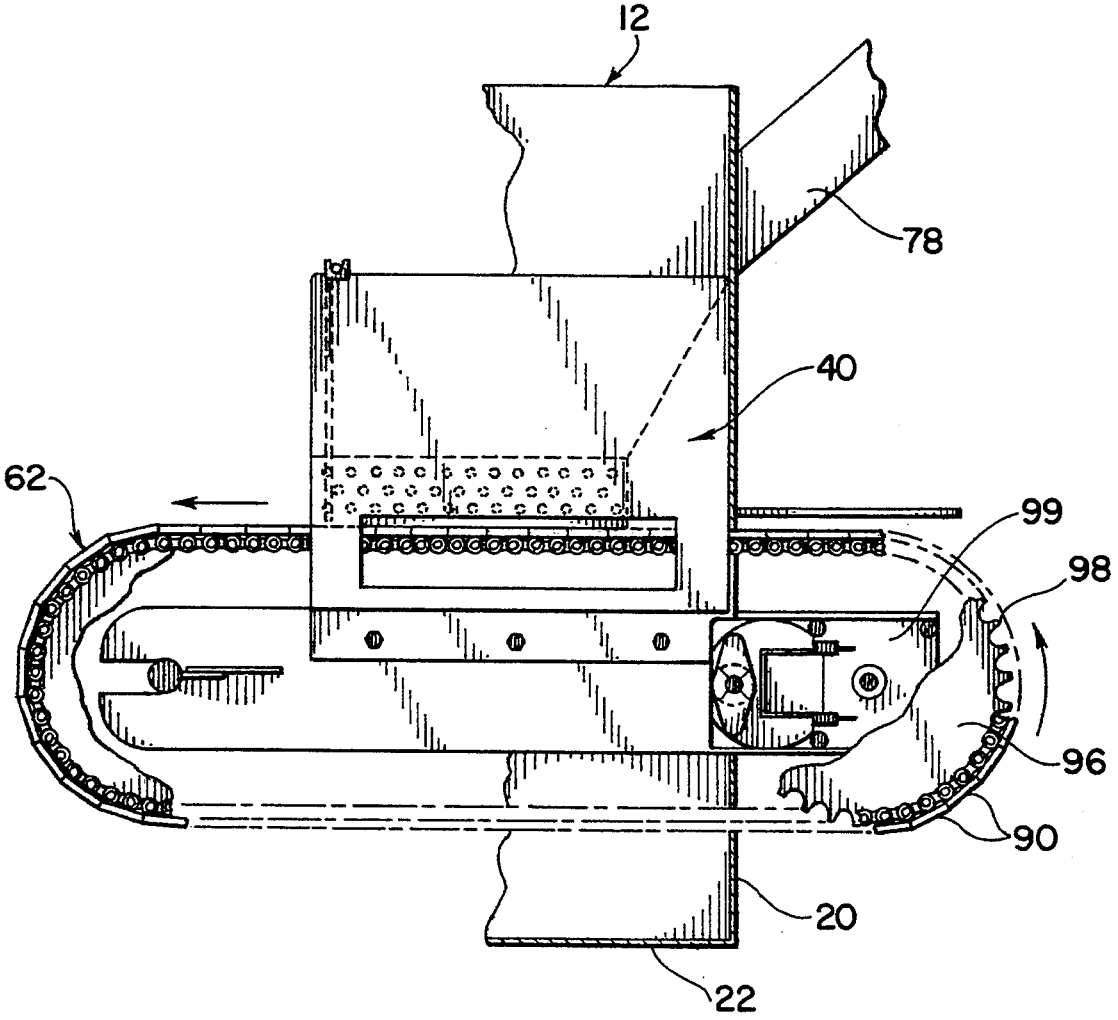
FIG. 3 is a side sectional view on an enlarged scale of the firebox and movable track system.

Turning now to FIGS. 3 and 4 of the drawings in particular, the supporting mechanisms for the track 62 as well its relationship with the firebox 40 is better shown. Therein it will be clear that the track 62 is preferably made from a plurality of laterally extending metallic strips or segments 90 which are welded at their ends to links 92 which are in turn interconnected by means of pins 94 such that the overall track structure 62 is adapted to continuously move over a pair of longitudinally spaced dual sprocket pairs 96 having radially extending teeth 98 which extend between the individual link pairs 92 and in that manner are adapted to either continually or intermittently move by means of a suitable motor 99. Generally, the track 62 movement is intermittent, that is, it preferably moves a fraction of an inch every predetermined time period. Both distance movement and time interval are selected depending upon the type of fuel being burned and the furnace heat requirements. Similarly, the individual fuel pellets are, accordingly, also timed to enter the combustion chamber 56 via the inlet 70 according to the same criteria.

As the combustible material is burned, it produces an ash or clinker which tends to settle in the lower portion of the material layer being burned, that is, immediately adjacent or on top of the track 62. Also dependent on the type of material being burned and the thickness of the ash or residue layer, the gate 100 positioned at the downstream end of the combustion chamber and supported by the end walls 50 as by extension arms 102 in turn adapted to be supported in spacer elements 104 attached to the upper edge of the side walls 44. Thus the bottom edge 106 of the gate 100 is adapted robe positioned a distance above the upper surface of the track 62 such that the ash residue remaining thereon passes thereunder while any unburned material is retained for a longer time in the combustion chamber. Such ash residue simply spills over and is deposited on top of the bottom wall 22 of the outer housing as the track moves downwardly about the sprocket 96 and at a point within the outer chamber 12 forwardly of the combustion chamber 56. In this manner then, the continuous fuel burning and the continuous or intermittent ash residue dumping enables extended periods of furnace operation and thus enables the furnace to be operated for a period of say a week or two without being shut down for servicing, cleaning and ash removal which is the case in prior art devices which essentially rely on a batch burn method lasting for shorter periods, e.g., twelve hours up to one day.

It can thus be seen by the foregoing description that an efficient and improved furnace system has been described which achieves the objectives of the invention. Further constructional aspects of the invention are provided by the following descriptive matter originally incorporated into the parent application hereof.

The Track

The track may be manufactured from suitable material such as Type 304 stainless steel tempered into eleven to sixteen gauge stock thickness. Stainless steel was chosen over other heat resistant material as it can withstand intense heat while retaining structural integrity and provides for the easy removal of ash, residue and clinkers. A single track component may be five inches long, one inch wide and 00.125 of an inch thick and contains perforated holes which vary in numbers and size to accommodate different fuels. Hole measurements vary in size allowing for differences in the diverse fuels burned.

Each track is welded to a standard roller chain link with a continuous loop formed around the sprockets on each side of the track. The tracks may be individually welded to the chain links providing for separation and movement in order to break up unusually hard or adhesive ash and clinkers common to some fuels. The track passes over two sprockets on each side which move the track on the chain at a predetermined intermittent rate. This movement assists separation of residue ash from the track. The sprockets may be six inches in diameter as provided in several test models. The sprockets are attached by a middle brace containing two axles that generate movement of the chain link loop at designated acceleration rates.

Motor

Each motor has a specially constructed shaft placed directly through its drive in order to produce predetermined acceleration by turning of the axle and both sprockets. A Merkle Korff motor built with a special driver stud may be utilized. The driver stud penetrates directly through the motor to be exposed and attached from both sides to a sprocket. The shaft moves the sprockets evenly creating momentum to drive the moving track floor. The Merkle Korff motor sits between the sprockets under the firebox and drives the moving mechanism. The motor is controlled by a time delay relay intermittent timer which allows the track to move various distances, e.g., 00.0075 of an inch every ten to twenty minutes, depending upon the type of fuel being consumed.

Firebox

Each firebox shell may be fabricated from stainless steel with perforated holes on the sides and walls providing for combustion air to fully feed the firebox chamber area. Firebox sides are preferably pitched at forty degrees providing for an unobstructed fuel flow into the firebox shell and onto the moving track floor. The size of the existing firebox shell is 8.75 inches long and 7.25 inches wide which is the result of repeated empirical and actual tests. The firebox wall located directly below the fuel drop chute contains air holes providing forced air to intercept hot air seeking to rise into the fuel feed chamber. The side profile of the firebox containing the rectangular opening is the point where combustion air is fed into the fire chamber. Each combustion blower has a rheostat which allows the blower to operate at a variable speed different for each fuel type.

The middle of the firebox has an opening in the center of the firebox that provides the moving track floor to pass through. Further rectangular cuts on both sides of the firebox provide the chain link loop to advance without exposing the chain to foreign matter, ash or residue generated in the burn area.

The fuel separation gate is placed at the end of the firebox shell to concentrate the burning area of the bio-mass fuel. As the track leaves the combustion zone area of the firebox, it passes under a fuel separation gate that separates completely burnt residue from partially burned residue allowing the former to pass underneath and into the ash depository and provides for the latter to be kept in the combustion zone until consumed.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for the improved burning of bio-mass and synthetic solid fuels comprising an outer chamber formed by a plurality of outer housing walls, a combustion firebox mounted in said outer chamber, means for feeding fuel to said firebox, said outer chamber further including means for supplying combustion air to said firebox and means for exhausting combustion gases from said outer chamber, said firebox including stationary side walls laterally spaced from each other in part forming a longitudinally extending trough-like combustion chamber having upstream and downstream ends thereof, said combustion chamber further defined by a stationary wall at said upstream end and a gate at said downstream end and a lower wall disposed between said firebox side walls, said gate having a lower edge positioned proximal to but vertically spaced from said lower wall, and means for longitudinally moving said lower wall between said firebox side walls from said stationary upstream wall towards and past said gate so as to continually remove ash from said firebox and deposit such ash into said outer chamber.

2. The device of claim 1, said lower wall being a longitudinally movable track having an upper surface on which a layer of fuel and ash is supported during combustion.

3. The device of claim 2, said track being in the form of a continuous loop and supported at upstream and downstream ends thereof by toothed sprockets and at least one of said sprockets having associated motor means to rotate said sprocket so as to in turn move said belt.

4. The device of claim 2, said track having a plurality of holes therethrough for the supply of combustion air to said combustion chamber through the layer of fuel and ash retained thereon.

5. The device of claim 4, said firebox side walls being provided with a series of holes for receipt of combustion air therethrough.

6. The device of claim 2, said gate being vertically adjustable so as to vary the distance to which such is spaced from the upper surface of said track.

7. The device of claim 5, said firebox having a hollow interior and having means for introducing combustion air thereinto such that said air is simultaneously forced through the holes in both said track and said side walls.

8. The device of claim 7, there being a pair of opposed side walls each having upper portions which downwardly inwardly slant so as to direct fuel to the combustion chamber in part formed by lower wall portions of said side walls, the combustion holes being formed in said lower wall portions.

9. The device of claim 1, said outer chamber including a fuel feeding opening positioned adjacent and above said upstream wall, and means for directing fresh combustion air across said upstream wall adjacent said fuel opening so as to direct combustion gases and heat away from such feed opening.

10. The device of claim 9, said stationary upstream wall being downwardly inwardly slanted towards said combustion chamber and said means for directing air thereacross including a pair of adjustably movable cowls mounted in said upstream wall and laterally spaced from said fuel entrance.

* * * * *